US009700858B2

(12) United States Patent
Iwako et al.

(10) Patent No.: US 9,700,858 B2
(45) Date of Patent: Jul. 11, 2017

(54) CONTINUOUS KNEADING DEVICE

(75) Inventors: Mayumi Iwako, Tokyo (JP); Masaaki Nakao, Tokyo (JP); Ryuji Kitamura, Tokyo (JP); Masakazu Abe, Minami-Uonuma (JP); Toshiaki Ueda, Iwaki (JP); Hiromichi Koizumi, Iwaki (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 21 days.

(21) Appl. No.: 14/006,188

(22) PCT Filed: Mar. 23, 2012

(86) PCT No.: PCT/JP2012/057458

§ 371 (c)(1),
(2), (4) Date: Sep. 19, 2013

(87) PCT Pub. No.: WO2012/128344

PCT Pub. Date: Sep. 27, 2012

(65) Prior Publication Data

US 2014/0010038 A1 Jan. 9, 2014

(30) Foreign Application Priority Data

Mar. 23, 2011 (JP) ..... 2011-064663

(51) Int. Cl.
*B01F 7/26* (2006.01)
*B01F 3/12* (2006.01)
(Continued)

(52) U.S. Cl.
CPC ..... *B01F 7/26* (2013.01); *B01F 3/1221* (2013.01); *B01F 5/221* (2013.01); *B01F 7/00041* (2013.01); *B01F 7/00775* (2013.01)

(58) Field of Classification Search
CPC ..... B01F 7/26; B01F 7/00041; B01F 7/0075; B01F 5/221; B01F 7/00491; B01F 7/0045; B01F 7/00775; B01F 7/00633
(Continued)

(56) References Cited

U.S. PATENT DOCUMENTS 1,084,210 A * 1/1914 Howard ..... B01F 3/04531 209/169
1,269,399 A * 6/1918 Davis ..... B01F 7/166 241/252
(Continued)

FOREIGN PATENT DOCUMENTS

CN 86100614 A 8/1986
CN 85101513 A 10/1986
(Continued)

OTHER PUBLICATIONS

Office Action mailed Sep. 24, 2014, issued for the Chinese patent application No. 201280014138.6 and English translation thereof.
(Continued)

*Primary Examiner* — Tony G Soohoo
*Assistant Examiner* — Elizabeth Insler
(74) *Attorney, Agent, or Firm* — Locke Lord LLP

(57) ABSTRACT

A continuous kneading device is provided with an upper trunk (1) to which a powder supply tube (3) through which quantified powder is supplied is connected and in which the powder is blended with a fluid, and a lower trunk (2) concentrically connected to the bottom of the upper trunk (1). The continuous kneading device continuously kneads the powder and the fluid by a first rotating kneading plate (10) built into the upper trunk (1) and a second rotating kneading plate (11) built into the lower trunk (2), wherein surfaces of the base metals of the first and second rotating kneading plates (10, 11) are covered with a coating material
(Continued)

(50) for reducing friction when the powder and the fluid are kneaded together.

13 Claims, 7 Drawing Sheets

(51) Int. Cl.
*B01F 5/22* (2006.01)
*B01F 7/00* (2006.01)

(58) Field of Classification Search
USPC ..... 366/91
See application file for complete search history.

(56) References Cited

U.S. PATENT DOCUMENTS 3,416,740 A * 12/1968 Hodgson ..... B02C 17/16 241/188.1
3,640,475 A * 2/1972 Jung ..... B02C 13/1814 241/188.2
4,175,873 A * 11/1979 Iwako ..... B01F 5/26 366/165.3
4,657,400 A * 4/1987 Suehisa ..... B01F 7/00775 366/144
4,691,867 A * 9/1987 Iwako ..... B01F 7/00766 241/101.8
4,915,509 A * 4/1990 Sauer ..... B01F 5/0683 366/149
6,019,498 A * 2/2000 Hamada ..... B01F 3/1221 241/46.017
2006/0192038 A1 8/2006 Sekine
2008/0312090 A1 * 12/2008 Fresco ..... B01J 19/0046 506/3

FOREIGN PATENT DOCUMENTS

| | | | |
|---|---|---|---|
| CN | 1950183 | A | 4/2007 |
| EP | 0605781 | B1 | 7/1997 |
| GB | 2169814 | A | 7/1986 |
| JP | 52-081759 | A | 7/1977 |
| JP | 58-091433 | U | 6/1983 |
| JP | 61-268344 | A | 11/1986 |
| JP | S61-263623 | A | 11/1986 |
| JP | 05-002735 | U | 1/1993 |
| JP | 08-155940 | A | 6/1996 |
| JP | 2002-191953 | A | 7/2002 |
| JP | 2003-062548 | A | 3/2003 |
| JP | 2004-290908 | A | 10/2004 |
| JP | 2005-313040 | A | 11/2005 |
| JP | 3730216 | B2 | 12/2005 |
| JP | 2010-521288 | A | 6/2010 |
| JP | 2010-279896 | A | 12/2010 |
| JP | 2011-067780 | A | 4/2011 |
| TW | I305536 | B | 1/2009 |
| WO | WO-2005/095073 | A1 | 10/2005 |
| WO | WO-2005/118242 | A1 | 12/2005 |
| WO | WO-2007/097004 | A1 | 8/2007 |
| WO | WO-2008/115173 | A1 | 9/2008 |

OTHER PUBLICATIONS

International Search Report dated May 1, 2012, issued for PCT/JP2012/057458 and English translation thereof.
Office Action mailed on Oct. 20, 2015 issued for corresponding Japanese Patent Application No. 2012-052608.
Office Action dated on Dec. 23, 2015 issued for corresponding Taiwanese Patent Application No. 101110144.

* cited by examiner

FIG. 6

| BASE METAL | COATING | DYNAMIC FRICTION COEFFICIENT $\mu$ |
|---|---|---|
| ALUMINUM | NONE | 0.6 |
| STAINLESS STEEL | NONE | 0.5 |
| ALUMINUM | TiN | 0.4 |
| STAINLESS STEEL | TiN | 0.4 |
| ALUMINUM | TiCN | 0.3 |
| STAINLESS STEEL | TiCN | 0.3 |
| ALUMINUM | DLC OR PEEK | 0.1 |
| STAINLESS STEEL | DLC OR PEEK | 0.1 |
| ALUMINUM | PTFE | 0.05 |
| STAINLESS STEEL | PTFE | 0.05 |

STAINLESS STEEL JIS SUS304
ALUMINUM JIS A2014

FIG. 7

| | | EXAMPLE 1 | EXAMPLE 2 | EXAMPLE 3 | EXAMPLE 4 | EXAMPLE 5 | EXAMPLE 6 | EXAMPLE 7 | EXAMPLE 8 | EXAMPLE 9 | EXAMPLE 10 | EXAMPLE 11 | EXAMPLE 12 | COMPARATIVE EXAMPLE 1 | COMPARATIVE EXAMPLE 2 | COMPARATIVE EXAMPLE 3 |
|---|---|---|---|---|---|---|---|---|---|---|---|---|---|---|---|---|
| DEVICE CONFIGURATION | | | | | | | | | | | | | | | | |
| ROTARY KNEADING DISC(FIRST AND SECOND ROTARY KNEADING DISC) | COATING | DLC | DLC | PTFE | PEEK | TiCN | TiN | DLC | TiCN | TiN | NONE | NONE | NONE | NONE | NONE | NONE |
| | BASE METAL | STAINLESS STEEL | STAINLESS STEEL | STAINLESS STEEL | STAINLESS STEEL | STAINLESS STEEL | STAINLESS STEEL | STAINLESS STEEL | STAINLESS STEEL | STAINLESS STEEL | PTFE | PEEK | PTFE | STAINLESS STEEL | STAINLESS STEEL | ALUMINUM |
| BLADE (SCRAPE BLADE) | COATING | DLC | DLC | PTFE | PEEK | TiCN | TiN | DLC | TiCN | TiN | NONE | NONE | NONE | NONE | NONE | NONE |
| | BASE METAL | STAINLESS STEEL | STAINLESS STEEL | STAINLESS STEEL | STAINLESS STEEL | STAINLESS STEEL | STAINLESS STEEL | STAINLESS STEEL | ALUMINUM | STAINLESS STEEL | PTFE | PEEK | PTFE | STAINLESS STEEL | STAINLESS STEEL | ALUMINUM |
| INNER SURFACE OF UPPER TRUNK | COATING | DLC | DLC | PTFE | PEEK | TiCN | TiN | PEEK | PEEK | PEEK | NONE | NONE | PEEK | NONE | NONE | NONE |
| | BASE METAL | STAINLESS STEEL | STAINLESS STEEL | STAINLESS STEEL | STAINLESS STEEL | STAINLESS STEEL | STAINLESS STEEL | ALUMINUM | STAINLESS STEEL | STAINLESS STEEL | PTFE | PTFE | STAINLESS STEEL | STAINLESS STEEL | STAINLESS STEEL | ALUMINUM |
| INNER SURFACE OF LOWER TRUNK | COATING | DLC | DLC | PTFE | PEEK | TiCN | TiN | PEEK | PEEK | PEEK | NONE | NONE | PEEK | NONE | NONE | NONE |
| | BASE METAL | STAINLESS STEEL | STAINLESS STEEL | STAINLESS STEEL | STAINLESS STEEL | STAINLESS STEEL | STAINLESS STEEL | ALUMINUM | STAINLESS STEEL | STAINLESS STEEL | PTFE | PTFE | STAINLESS STEEL | STAINLESS STEEL | STAINLESS STEEL | ALUMINUM |
| ROTATIONAL SPEED OF ROTARY KNEADING DISC (rpm) | | 4000 | 4000 | 3500 | 4000 | 4250 | 4250 | 4000 | 4000 | 4000 | 4000 | 2000 | 2000 | 4000 | 4000 | 4000 |
| POWDER RAW MATERIAL | | MIXED POWDER FOR FOOD | QUARTZ POWDER | QUARTZ POWDER | QUARTZ POWDER | QUARTZ POWDER | QUARTZ POWDER | QUARTZ POWDER | QUARTZ POWDER | QUARTZ POWDER | MIXED POWDER FOR FOOD | QUARTZ POWDER | QUARTZ POWDER | MIXED POWDER FOR FOOD | QUARTZ POWDER | QUARTZ POWDER |
| LIQUID RAW MATERIAL | | SALINE WATER | ION EXCHANGED WATER | ION EXCHANGED WATER | ION EXCHANGED WATER | ION EXCHANGED WATER | ION EXCHANGED WATER | ION EXCHANGED WATER | ION EXCHANGED WATER | ION EXCHANGED WATER | SALINE WATER | ION EXCHANGED WATER | ION EXCHANGED WATER | SALINE WATER | ION EXCHANGED WATER | ION EXCHANGED WATER |
| SOLID CONCENTRATION OF SLURRY (wt%) | | 60 | 60 | 60 | 60 | 60 | 60 | 60 | 60 | 60 | 60 | 60 | 60 | 60 | 59 | 63 |
| DISCHARGE PERCENT OF SLURRY (%) (DISCHARGE AMOUNT/SUPPLY AMOUNT X 100) | | 100 | 100 | 100 | 100 | 97 | 95 | 100 | 100 | 100 | 100 | 100 | 100 | 95 | 85 | 85 |
| SLURRY TEMPERATURE (°C) | | 29 | 32 | 29 | 31 | 42 | 48 | 33 | 35 | 38 | 32 | 33 | 30 | 56 | 60 | 60 |
| VISCOSITY OF SLURRY (mPa.S) | | 170 | 180 | 170 | 190 | 385 | 435 | 190 | 250 | 270 | 160 | 180 | 180 | 420 | 580 | 640 |

CONTINUOUS KNEADING DEVICE

TECHNICAL FIELD

The present invention relates to a continuous kneading device for continuously blending and kneading powder, such as quartz powder, and a liquid, and a continuous kneading device capable of efficiently and continuously blending microscopic particles in a submicron order with a liquid material.

Priority is claimed on Japanese Patent Application No. 2011-064663, filed Mar. 23, 2011, the content of which is incorporated herein by reference.

BACKGROUND ART

In the related art, continuous kneading devices as shown in PTLs 1 and 2, which continuously knead powder, such as quartz powder, and a liquid, are known.

A continuous kneading device of PTL 1 is configured so that upper- and lower-stage kneading chambers having rotary kneading discs housed and arranged therein are provided and powder and a liquid are supplied to the upper-stage kneading chamber at the same time so as to perform kneading, the diameter of the rotary kneading disc in the upper-stage kneading chamber is set to be smaller than the diameter of the rotary kneading disc in the lower-stage kneading chamber, and the powder kneaded with the liquid while being moved in a centrifugal direction in the upper-stage rotary kneading disc is directly introduced into a kneading region on the rotary kneading disc in the lower-stage kneading chamber from the outer peripheral edge portion of the upper-stage rotary kneading disc.

In a continuous blending device of PTL 2 configured so that powder and a liquid are continuously supplied into a blending chamber including a rotary blending disc to obtain a uniform blending fluid of the powder and the liquid by the rotary blending disc, a non-metallic sleeve made of thermoplastic resin having low heat generation from friction is replaceably mounted on an inner surface portion of the blending chamber.

CITATION LIST

Patent Literature

[PTL 1] Japanese Unexamined Patent Application, First Publication No. 2002-191953

[PTL 2] Japanese Unexamined Patent Application, First Publication No. 2004-290908

SUMMARY OF INVENTION

Problem to be Solved by the Invention

In the continuous kneading/blending device configured as described above, a stainless steel material is used as a base metal of a rotary blending disc or the like that comes into contact with kneaded matter (slurry) of powder and a liquid and blends the kneaded matter. However, since the wettability of the surface of the slurry and the surface of the stainless steel material is favorable, the slurry may adhere to the stainless steel material. Where a target to be kneaded is a plurality of microscopic particles equal to or less than submicron order, favorable kneading cannot be performed, and the viscosity of the slurry becomes high. As a result, problems occur such as discharge deterioration of the slurry from the device and characteristics of a product may change due to a rise in temperature of the slurry.

Since the rotary kneading disc that is a constituent member of the device is rotatably supported via a bearing, the area of contact with other members is narrow. Therefore, frictional heat is not dissipated easily, and the temperature of the rotary kneading disc increases compared to other members.

The present invention has been made in view of the above-described situation, and an object of the invention is to provide a continuous kneading device capable of providing excellent kneading performance for a slurry during rotational kneading, securing excellent discharge performance from the device as the viscosity of the slurry is lowered, and also lowering the temperature of the slurry.

Means for Solving the Problem

Since a material with a low dynamic friction coefficient generally has low wettability, the present inventors focused on a dynamic friction coefficient of the material. Thus, the inventors changed the materials of respective members constituting the interior of a device, specifically, constituent members that directly come into contact with an object to be kneaded, and performed various tests. As a result, the inventors found that the viscosity and temperature of a slurry is lowered as kneading proceeds where the constituent members inside the device are constituted of materials with low dynamic friction coefficients, and thus realized the invention.

A continuous kneading device related to the invention includes an upper trunk to which a powder supply tube through which quantified powder is supplied is connected and in which the powder is blended with a liquid, and a lower trunk concentrically connected to the lower side of the upper trunk, the powder and the liquid are continuously kneaded by a first rotary kneading disc built in the upper trunk and a second rotary kneading disc built in the lower trunk, and at least surfaces of the first and second rotary kneading discs are constituted of a material having a lower dynamic friction coefficient than that of metal. In addition, the metal includes, for example, stainless steel (JISSUS304).

In the continuous kneading device related to the invention, the surfaces of the base metals of the first and second rotary kneading discs may be covered with a coating material, and any material of diamond-like carbon (also called amorphous carbon and referred to as DLC), polyether ether ketone (hereinafter referred to as PEEK), polytetrafluoroethylene (hereinafter referred to as PTFE), titanium nitride (hereinafter referred to as TiN), and titanium carbonitride (hereinafter referred to as TiCN) may be used as the coating material.

In the continuous kneading device related to the invention, inner surfaces of the upper trunk and the lower trunk may be covered with a coating material having a lower dynamic friction coefficient than that of metal.

In the continuous kneading device related to the invention, the coating material covered on the inner surfaces of the upper trunk and the lower trunk may be PEEK.

According to the invention configured as described above, at least surfaces of the first rotary kneading disc located within the upper trunk and the second rotary kneading disc located within the lower trunk may are constituted of a material having a lower dynamic friction coefficient than that of metal. For example, since the substrate surfaces of the first rotary kneading disc located within the upper trunk and the second rotary kneading disc located within the lower trunk are subjected to DLC coating, PEEK coating, PTFE coating, TiN coating, or TiCN coating, excellent kneading performance of the slurry can be obtained because of the coating material, and the viscosity of the slurry can be lowered. Accordingly, excellent discharge performance from the device can be secured, and it is also possible to lower the temperature of the slurry and the temperature of the first and second rotary kneading discs.

In the continuous kneading device related to the invention, the first rotary kneading disc and the second rotary kneading disc may are constituted of a resin material having a lower dynamic friction coefficient than that of metal. However, this case is also the same as the above.

In the continuous kneading device related to the invention, a shearing kneading portion may be provided between a lower surface of the inner flange portion from which a lower end of the upper trunk protrudes inward in a radial direction of the upper trunk, and an upper surface of the second rotary kneading disc within the lower trunk, the shearing kneading portion may have a fixed plate fixed to the lower surface of the inner flange portion, and a rotary plate fixed to the upper surface of the second rotary kneading disc and rotates together with the second rotary kneading disc, the rotary plate may rotate in a state where the rotary plate faces an upper surface of the fixed plate, and thereby a shearing force is given to the kneaded matter of the powder and the liquid between the fixed plates and the rotary plate, and at least the surfaces of the rotary plate and the fixed plate of the shearing kneading portion may are constituted of a material having a lower dynamic friction coefficient than that of metal.

In addition, the expression "at least the surfaces of the rotary plate and the fixed plate of the shearing kneading portion are constituted of a material having a lower dynamic friction coefficient than that of metal" means a case where the rotary plate and the fixed plate of the shearing kneading portion have the substrate surfaces coated with a material having a lower dynamic friction coefficient than that of metal, and a case where the rotary plate and the fixed plate of the shearing kneading portion are constituted of the material itself having a lower dynamic friction coefficient than that of metal.

Additionally, in the continuous kneading device related to the invention, concavo-convex portions may be formed in the surfaces of the fixed plate and the rotary plate of the shearing kneading portion that face each other.

According to the invention configured as described above, the fixed plate fixed to the lower surface of the inner flange portion of the upper trunk, and the rotary plate fixed to the upper surface of the second rotary kneading disc and rotates together with the second rotary kneading disc constitute the shearing kneading portion, and as the rotary plate of the shearing kneading portion rotates with respect to the fixed plate, a shearing force can be given to the kneaded matter (slurry) of the powder and the liquid between the rotary plate and the fixed plate. At this time, a large shearing force can be given to the kneaded matter (slurry) of the powder and the liquid by knurling cutting work or formation of the concavo-convex portions by recessed grooves in the surfaces of the fixed plate and the rotary plate of the shearing kneading portion that face each other.

In the present invention, a resin material having a lower dynamic friction coefficient than that of metal may be PEEK or PTFE.

Advantageous Effects of Invention

According to the invention, at least the surfaces of the first rotary kneading disc located within the upper trunk and the second rotary kneading disc located within the lower trunk are constituted of a material having a lower dynamic friction coefficient than that of metal. For example, if the substrate surfaces of the first rotary kneading disc located within the upper trunk and the second rotary kneading disc located within the lower trunk are subjected to DLC coating, PEEK coating, PTFE coating, TiN coating, or TiCN coating, the wettability of the coating material is low. Thus, excellent kneading performance of the slurry can be obtained by the coating material, and the viscosity of the slurry can be lowered. Accordingly, excellent discharge performance from the device can be secured, and it is also possible to lower the temperature of the slurry.

The fixed plate fixed to the lower surface of the protruding portion of the upper trunk, and the rotary plate fixed to the upper surface of the second rotary kneading disc and rotates together with the second rotary kneading disc constitute the shearing kneading portion, and as the rotary plate of the shearing kneading portion rotates with respect to the fixed plate, a shearing force can be given to the kneaded matter of the powder and the liquid between the rotary plate and the fixed plate. At this time, a large shearing force can be given to the kneaded matter of the powder and the liquid by knurling cutting work or formation of the concavo-convex portions by recessed grooves in the surfaces of the fixed plate and the rotary plate of the shearing kneading portion that face each other.

BRIEF DESCRIPTION OF DRAWINGS

FIG. 2(A) is a plan view and FIG. 2(B) is a front cross-sectional view in a radial direction.

FIG. 3(A) is a bottom view and FIG. 3(B) is a front cross-sectional view in the radial direction.

FIG. 4(A) is a plan view and FIG. 4(B) is a front cross-sectional view in the radial direction.

FIG. 5(A) is a bottom view and FIG. 5(B) is a front cross-sectional view in the radial direction.

FIG. 6 is a graph illustrating base metals made of different metallic materials and differences in dynamic friction coefficient where the surfaces of the base metals are covered with various coating materials.

FIG. 7 is a graph illustrating examples illustrating the viscosity of a slurry and the temperature of the slurry where being kneaded by the continuous kneading device 100 related to the invention and a continuous kneading device related to comparative examples.

DESCRIPTION OF EMBODIMENT

A continuous kneading device related to the invention will be described with reference to FIGS. 1 to 5.

Figure 1:
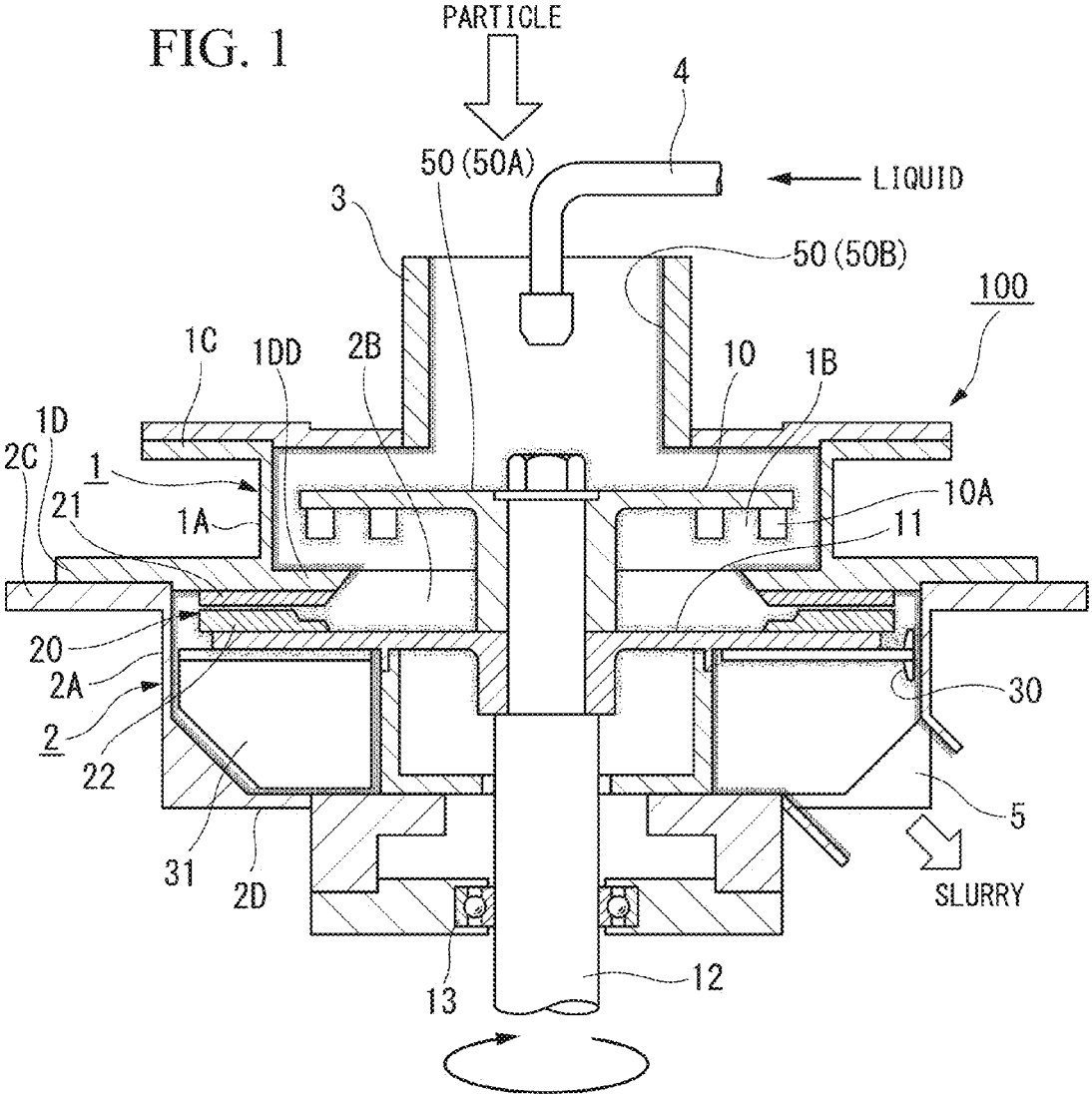
FIG. 1 is a front cross-sectional view of a continuous kneading device 100 related to the invention.

FIG. 1 is a front cross-sectional view of a continuous kneading device 100 related to the invention. In this figure, an upper trunk is designated by reference numeral 1 and a lower trunk that is concentrically fixed to the lower side of the upper trunk 1 is designated by reference numeral 2.

In the upper trunk 1, the interior of an upper trunk body 1A serves as a first kneading chamber 1B, and a powder supply cylinder 3 connected to a powder supply unit (not shown) that continuously supplies a predetermined amount of powder, and a liquid supply pipe 4 connected to a liquid supply unit (not shown) that supplies a liquid to be mixed with the powder are arranged in an upper portion of the first kneading chamber 1B.

Additionally, flange portions 1C and 1D that protrude radially outward are integrally formed at an upper edge portion and a lower edge portion of the upper trunk body 1A of the upper trunk 1, the powder supply cylinder 3 is fixed to the flange portion 1C, and the lower trunk 2 is fixed to the flange portion 1D.

In the lower trunk 2, the interior of a lower trunk body 2A serves as a second kneading chamber 2B.

Additionally, a flange portion 2C that protrudes radially outward is integrally framed at an upper edge portion of the lower trunk body 2A of the lower trunk 2, and the lower flange portion 1D of the upper trunk 1 is brought into contact with and fixed to the flange portion 2C.

Additionally, a bottom plate 2D that is horizontally arranged is integrally formed at a lower edge portion of the lower trunk body 2A of the lower trunk 2, and a discharge port 5 for discharging a slurry that is kneaded matter of powder and a liquid is provided between the bottom plate 2D and the lower trunk body 2A.

The internal diameter of the second kneading chamber 2B of the lower trunk 2 is formed so as to be larger than the internal diameter of the first kneading chamber 1B within the upper trunk 1, and the first kneading chamber 1B and the second kneading chamber 2B are provided in a state where they connect to each other.

A first rotary kneading disc 10 and a second rotary kneading disc 11 are arranged in the first kneading chamber 1B and the second kneading chamber 2B, respectively, and the first rotary kneading disc 10 and the second rotary kneading disc 11 are driven by a common rotation drive shaft 12.

The rotation drive shaft 12 is supported by a bearing 13 so as to pass through a center portion of the bottom plate 2D, and is connected to and rotationally driven by an external drive source (not shown) arranged at a lower end portion thereof. Additionally, a plurality of kneading pins 10A are provided on a lower surface of the first rotary kneading disc 10.

Since the internal diameter of the second kneading chamber 2B of the lower trunk 2 is formed so as to be larger than the internal diameter of the first kneading chamber 1B within the upper trunk 1, a lower portion of the upper trunk 1 is formed in a shape that protrudes inward (rotation drive shaft 12 side). Here, an inner flange portion 1DD is formed inside the flange portion 1D of the upper trunk 1 so as to protrude to the kneading chamber 1B and 2B side, and a shearing kneading portion 20 is provided between the (outer) flange portion 1D and a lower surface of the inner flange portion 1DD and an upper surface of the second rotary kneading disc 11 in the lower trunk 2.

The shearing kneading portion 20 has a fixed plate 21 fixed to the lower surface of the flange portion 1D and the inner flange portion 1DD of the upper trunk 1 and a rotary plate 22 fixed to the upper surface of the second rotary kneading disc 11 and rotates together with the second rotary kneading disc 11. As the rotary plate 22 rotates with the rotation of the second rotary kneading disc 11, a shearing force is given to the slurry that is the kneaded matter of the powder and the liquid between the rotary plate and the fixed plate 21.

Additionally, a side scraper 30 for scraping off the slurry from an inner surface portion of the lower trunk body 2A is arranged at a peripheral edge portion in a radial fashion. And a scrape blade 31 for guiding the slurry to the discharge port 5 is arranged at a lower surface of the second rotary kneading disc 11 in a radial fashion.

In addition, the supply of a liquid to the kneading chambers 1B and 2B is not limited to being performed through the powder supply cylinder 3, and a configuration may also be attached in which an overflow cone is provided so as to surround the powder supply cylinder 3 and the overflow cone is used as an annular overflow membrane so as to cause the liquid to flow down.

Figure 2:
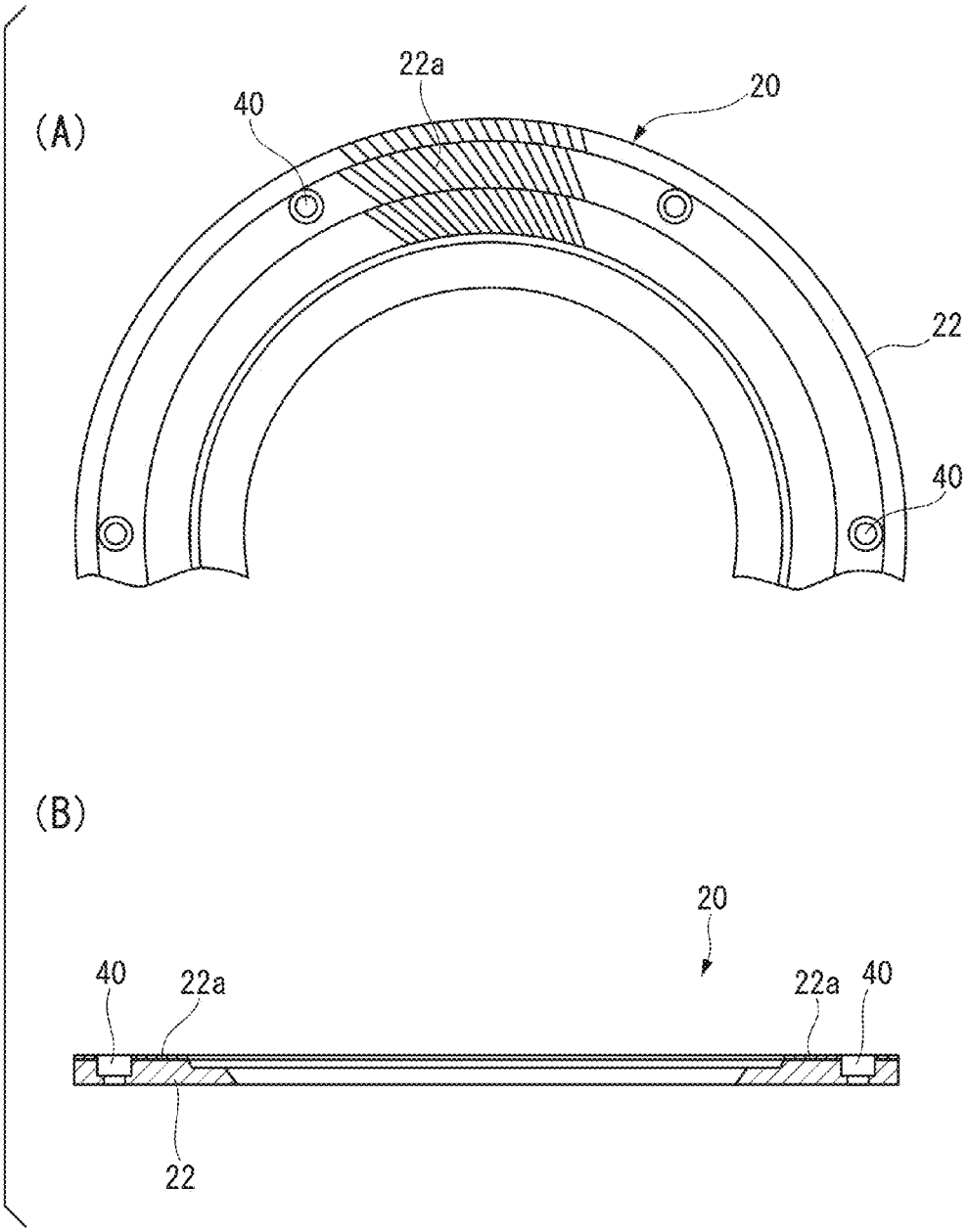
FIG. 2 is a view showing a rotary plate 22 of a second rotary kneading disc 11 that is knurled.
Figure 3:
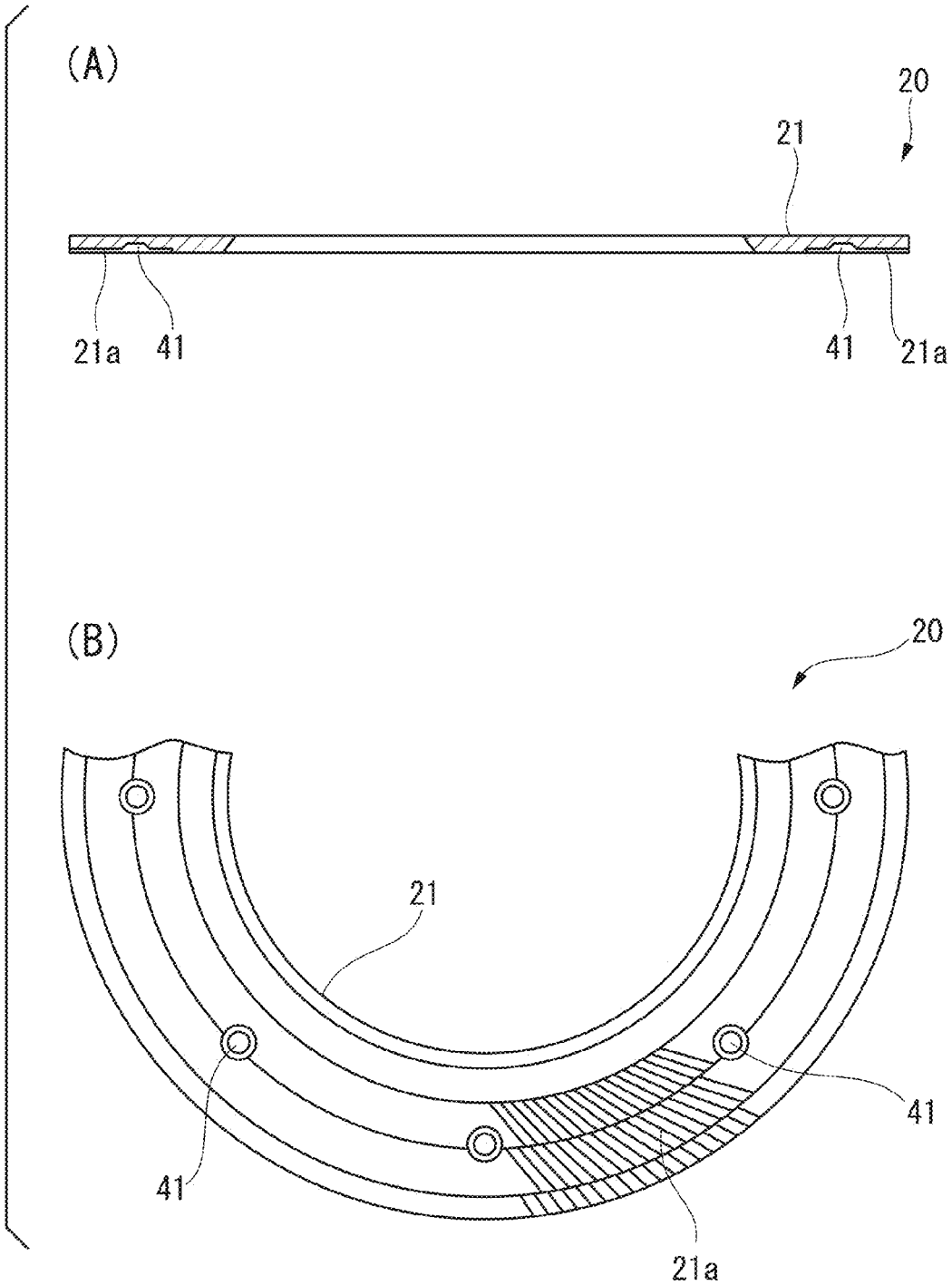
FIG. 3 is a view showing a fixed plate 21 on the side of an upper trunk 1 that is knurled.

Additionally, in the shearing kneading portion 20, as shown in FIG. 2, an upper surface of the rotary plate 22 of the second rotary kneading disc 11 is subjected to knurling cutting work (designated by reference numeral 22*a*) in a given direction that inclines with respect to a circumferential direction with a predetermined width. Additionally, as shown in FIG. 3, a lower surface of the fixed plate 21 of the upper trunk 1 that rotates relative to the rotary plate 22 is subjected to knurling cutting work (designated by reference numeral 21*a*) in a direction that intersects the knurl of the rotary plate 22. A proper shearing action is given to the slurry that is the kneaded matter of the powder and the liquid by the formation of the concavo-convex portions by the cutting work 21*a* and 22*a* on the rotary plate 22 and the fixed plate 21, so that a homogeneous slurry can be easily obtained.

In addition, mounting screws for fixing the rotary plate 22 to the second rotary kneading disc 11 are designated by reference numeral 40 in FIG. 2, and mounting screws for fixing the fixed plate 21 to the upper trunk 1 are designated by reference numeral 41 in FIG. 3.

Coating materials 50 (50A and 50B) that reduce friction with the slurry that is the kneaded matter of the powder and the liquid during kneading of the powder and the liquid cover the surfaces of the base metals of the first rotary kneading disc 10, the second rotary kneading disc 11, the first kneading chamber 1B within the upper trunk 1, and the second kneading chamber 2B of the lower trunk 2, during kneading of the powder and the liquid. In addition, the coating materials 50 (50A and 50B) are formed so as to coat whole surfaces including the knurling cutting work 21*a* and 22*a* provided in the rotary plate 22 and the fixed plate 21. Stainless steel, for example, is used as the base metals, and materials such as DLC, PEEK, PTFE, TiN, and TiCN are used as the coating materials covering the base metals.

Specifically, as shown in FIG. 1, a DLC coating (material), for example, is used as each coating material 50 (50A) that covers the surfaces of the first rotary kneading disc 10, the second rotary kneading disc 11, the fixed plate 21, and the scrape blade 31, and a PEEK coating (material), for example, is used as the coating material 50 (50B) that covers an inner surface of the first kneading chamber 1B within the upper trunk 1 and an inner surface of the second kneading chamber 2B excluding a DLC coating surface or a PTFE pure material surface of the fixed plate 21 of the lower trunk 2.

The reason why the DLC coating is used as each coating material 50 (50A) of the second rotary kneading disc 11 and the fixed plate 21 or the first rotary kneading disc 10 and the scrape blade 31 as described above is as follows. That is, the reason is because, since the surfaces of the rotary plate 22 and the fixed plate 21 that face each other are subjected to the knurling cutting work and are provided with the minute grooves, where an ordinary coating method is adopted, the minute grooves may be filled and there is a possibility of impairing the original function of the minute grooves, that is, a function to fulfill a high shearing action, but where coating is performed by using DLC by a sputtering method, the minute grooves are held as they are, and the original function of the minute grooves, that is, the function to fulfill a high shearing action, can be sufficiently exhibited. Additionally, the reason is because, since film thickness is as small as about 1 μm and uniform if coating is performed by using DLC, a coating layer is not easily peeled off from a base metal even when a strong shearing load is applied.

Additionally, the reason why a PEEK material is used as the coating material 50B for the respective inner surfaces of the first kneading chamber 1B in the upper trunk 1 and the second kneading chamber 2B in the lower trunk 2 is because, as compared to, for example, a case where PTFE-based resin is used, the PEEK material has equivalent performance in chemical resistance, water and oil repellency, and non-adhesiveness, but has durability ten times as great as fluororesin in wear resistance. Additionally, the reason is because the PEEK material also has a dynamic friction coefficient equivalent to that of fluororesin and also has a stable property against a temperature change.

In the continuous kneading device 100 of the embodiment configured in this way, powder is continuously supplied into the powder supply cylinder 3 at the upper surface center portion of the first rotary kneading disc 10 in the first kneading chamber 1B, and a liquid is supplied from the liquid supply pipe 4 by liquid supply means that is not shown, and the powder and the liquid are kneaded by the rotational driving of the first rotary kneading disc 10. Next, when the slurry that is the kneaded matter of the powder and the liquid passes between the rotary plate 22 and the fixed plate 21 of the shearing kneading portion provided at a boundary portion between the first kneading chamber 1B and the second kneading chamber 2B, a proper shearing action is given to the slurry, so that a homogeneous slurry can be easily obtained.

Additionally, in the continuous kneading device 100, the coating material 50 (50A) that reduces the friction with the slurry during kneading of the powder and the liquid covers the surfaces of the base metals of the first rotary kneading disc 10 located within the upper trunk 1 and the second rotary kneading disc 11 located within the lower trunk 2. For example, since the surfaces of the base metals of the first rotary kneading disc 10 located within the upper trunk 1 and the second rotary kneading disc 11 located within the lower trunk 2 are subjected to DLC coating, the excellent kneading performance of the slurry is obtained as the dynamic friction coefficient is lowered by the coating material, and a large aggregate of the powder is eliminated. Therefore, the viscosity of the slurry can be lowered. Accordingly, excellent discharge performance of the slurry from the device can be secured, and it is also possible to lower the temperature of the slurry.

Moreover, as the inner surfaces of the upper trunk 1 and the lower trunk 2 are covered with the PEEK coating that reduces the friction with the slurry during kneading of the powder and the liquid, excellent kneading performance of the slurry is obtained even in a contact portion between the inner surfaces of the upper trunk 1 and the lower trunk 2, and the viscosity of the slurry can also be lowered.

Additionally, in the continuous kneading device 100 shown in the present embodiment, as mentioned above, the shearing kneading portion 20 is constituted by the fixed plate 21 fixed to the lower surface of the flange portion 1D of the upper trunk 1 and the rotary plate 22 fixed to the upper surface of the second rotary kneading disc 11 and rotates together with the second rotary kneading disc 11, and the rotary plate 22 of the shearing kneading portion 20 rotates with respect to the fixed plate 21 so as to give a shearing force to the slurry that is the kneaded matter of the powder and the liquid between the rotary plate 22 and the fixed plate 21, and the surfaces of the rotary plate 22 and the fixed plate 21 are also subjected to DLC coating. Thus, excellent kneading performance of the slurry is also obtained.

In addition, the invention is not limited to the aforementioned embodiment, and various changes can be made without departing from the scope of the invention.

Figure 4:
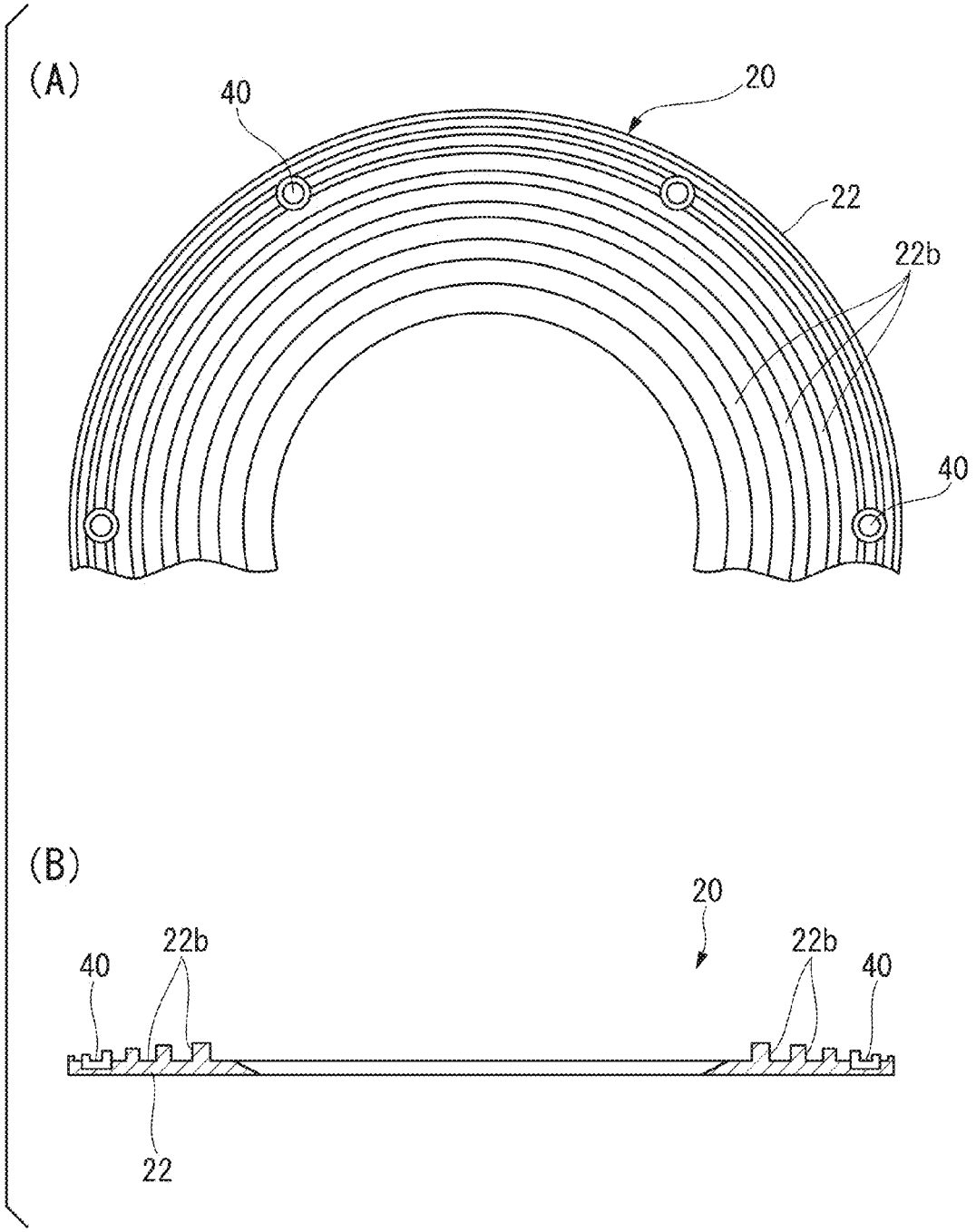
FIG. 4 is a view showing the rotary plate 22 of the second rotary kneading disc 11 that is formed with recessed grooves.
Figure 5:
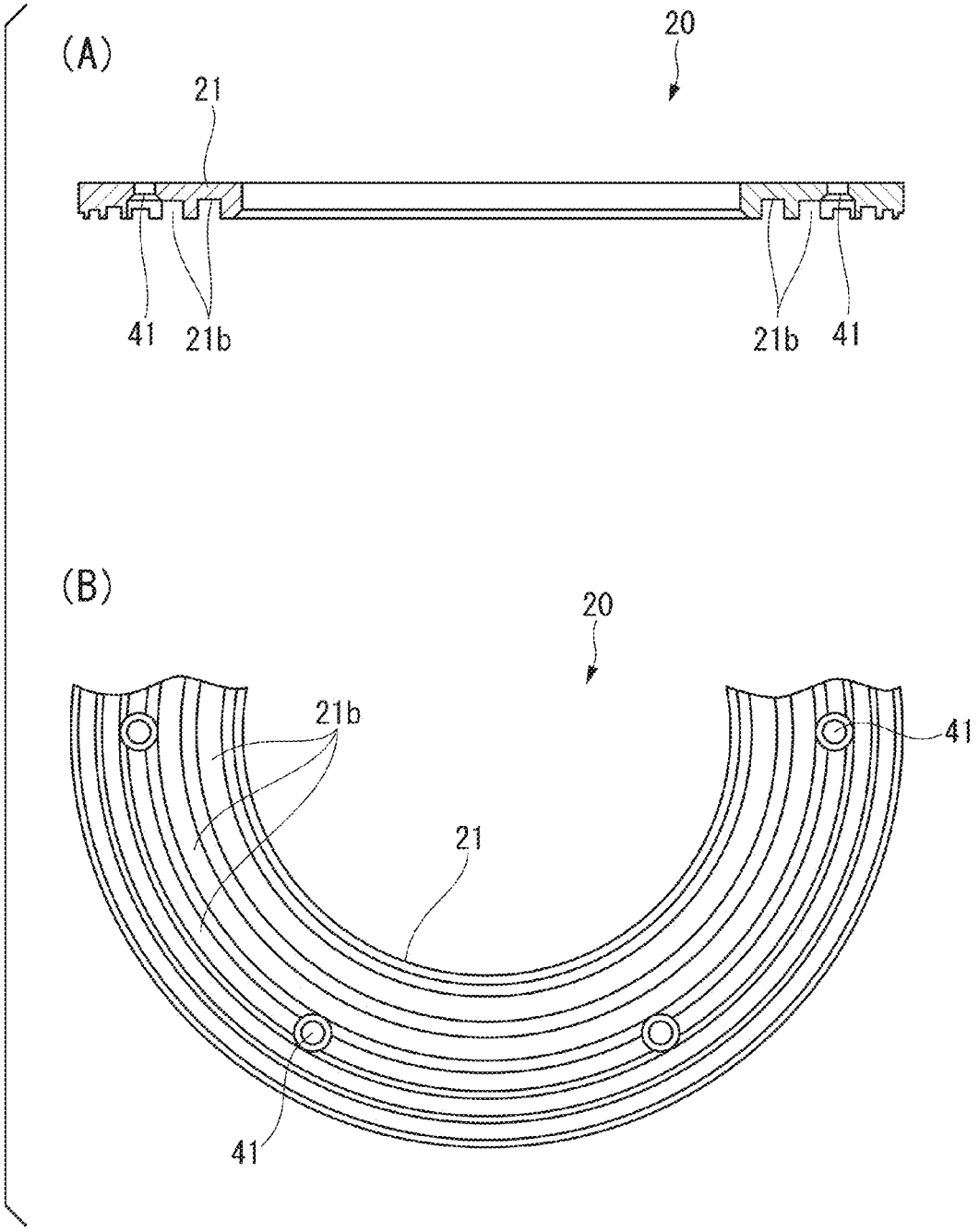
FIG. 5 is a view showing the fixed plate 21 on the side of the upper trunk 1 that is formed with recessed grooves.

For example, in the shearing kneading portion 20 of the above embodiment, the upper surface of the rotary plate 22 of the second rotary kneading disc 11 and the lower surface of the fixed plate 21 that rotates relative to the rotary plate 22 (designated by reference numerals 21*a* and 22*a*) are subjected to knurling cutting work, respectively. However, the invention is not limited to this, and as shown in FIG. 4 and FIG. 5, recessed grooves 21*b* and 22*b* may be formed at regular intervals in a radial direction so as to extend along the circumferential direction that is a rotational direction of the rotary plate 22 so that a shearing force is given to the slurry by concavo-convex portions formed by the recessed grooves 21*b* and 22*b*.

In this case, in order to prevent the temperature rise of a slurry caused by friction during blending to suppress the rise of the viscosity of the slurry and improve the discharge performance from the device, the whole upper surface of the rotary plate 22 and the whole lower surface of the fixed plate 21 including the recessed grooves 21*b* and 22*b* is covered with the coating material 50 (50A).

Additionally, in the present embodiment, the fluid together with the powder is supplied through the powder supply cylinder 3 coupled to the upper trunk 1. However, the invention is not limited to this, and a fluid injection nozzle may be provided in the lower flange portion 1D of the upper trunk 1 so that the fluid (the liquid) is directly supplied to a place (that is, a place where a shearing force is given to the slurry) where the fixed plate 21 and the rotary plate 22 of the shearing kneading portion 20 face each other.

Additionally, the fixed plate 21 of the shearing kneading portion 20 is fixed to the lower flange portion 1D of the upper trunk 1. However, the invention is not limited to this, and the fixed plate 21 may be rotationally driven in a direction opposite to the rotary plate 22 so that a larger shearing force is given to the slurry.

Additionally, in the embodiment, the lower trunk 2 is made to have a larger diameter than the upper trunk 1. However, the invention is not limited to this, and it is also possible to set the lower trunk 2 and the upper trunk 1 to almost the same diameter. In this case, the fixed plate 21 may be fixed to the lower surface of the inner flange portion 1DD provided in the upper trunk 1.

Additionally, in the embodiment, the coating materials 50 that reduce friction with the slurry cover the surfaces of the base metals of the first rotary kneading disc 10, the second rotary kneading disc 11, the first kneading chamber 1B within the upper trunk 1, and the second kneading chamber 2B of the lower trunk 2, during kneading of the powder and the liquid. However, the invention is not limited to this, and all or a portion of the first rotary kneading disc 10 or the second rotary kneading discs 11, for example, the side scraper 30 or the scrape blade 31 may be made of, for example, a resin material itself, such as PEEK or PTFE having a dynamic friction coefficient lower than that of metal. Similarly, the fixed plate 21 and the rotary plate 22 may also be made of, for example, a resin material itself, such as PEEK or PTFE having a dynamic friction coefficient lower than that of metal.

EXAMPLES

First, aluminum (JISA2014) and stainless steel (JIS-SUS304) were prepared as the base metals, and the base metals themselves without performing coating, a base metal whose surface was subjected to TiN coating, a substrate whose surface was subjected to TiCN coating, a base metal whose surface was subjected to DLC coating, a base metal whose surface was subjected to PEEK coating, and a substrate whose surface was subjected to PTFE coating were prepared, and the respective dynamic friction coefficients thereof were measured.

In addition, the dynamic friction coefficients were measured in a ball-on disc friction test performed by a Tribometer made by CSEM under the conditions that a load of 5 N to 20 N was added to a cemented carbide ball with a diameter of 6 mm at a room temperature.

The results are shown in FIG. 6. As can be seen from this figure, the dynamic friction coefficient of aluminum was 0.6 and the dynamic friction coefficient of stainless steel was 0.5. In contrast, where these base metals are subjected to coating, the dynamic friction coefficients were 0.4 for TiN coating, 0.3 for TiCN coating, 0.1 for DLC coating or PEEK coating, and 0.05 for PTFE coating.

Twelve examples and three comparative examples were prepared on the basis of these results, using the same structure as the continuous kneading device 100 related to the embodiment of the invention shown in the aforementioned FIGS. 1 to 3, and the viscosity of a slurry, the temperature of the slurry, and the like when powder and a liquid were kneaded in practice were investigated in these examples.

Specifically, a slurry was manufactured by rotating the two-stage rotary kneading discs 10 and 11 at 4000 rpm while supplying 3 to 50 kg/h of quartz powder or mixed powder for food from the powder supply cylinder 3, and continuously supplying 4 to 34 liters/h of ion exchanged water or saline water from the liquid supply pipe 4. The results are shown in FIG. 7.

Here, Example 1 is an example in which mixed powder for food (regular rice, starch, wheat protein, trehalose, and polysaccharide thickener) that is a powder raw material and 10 wt % saline water that is a liquid raw material were kneaded by using the surface of the rotary kneading discs 10 and 11, the surface of the scrape blade 31, the inner surface of the upper trunk 1, and the inner surface of the lower trunk 2 that were covered with a DLC coating (material). In addition, stainless steel was used as base metals of these members. In the following Examples 2 to 9, stainless steel was also used as a base metal of the rotary kneading disc 10 or the like.

Example 2 is an example in which quartz powder with an average particle diameter of volume standard of 0.8 μm that is a powder raw material and ion exchanged water that is a liquid raw material were kneaded by using the device having the same configuration as Example 1. Example 3 is an example in which quartz powder that is a powder raw material and ion exchanged water that is a liquid raw material were kneaded by using the surface of the rotary kneading discs 10 and 11, the surface of the scrape blade 31, the inner surface of the upper trunk 1, and the inner surface of the lower trunk 2, respectively that were covered with a PTFE coating (material). Example 4 is an example in which quartz powder that is a powder raw material and ion exchanged water that is a liquid raw material were kneaded by using the surface of the rotary kneading discs 10 and 11, the surface of the scrape blade 31, the inner surface of the upper trunk 1, and the inner surface of the lower trunk 2 that were covered with a PEEK coating (material), respectively. Example 5 is an example in which quartz powder that is a powder raw material and ion exchanged water that is a liquid raw material were kneaded by using the surface of the rotary kneading discs 10 and 11, the surface of the scrape blade 31, the inner surface of the upper trunk 1, and the inner surface of the lower trunk 2 that were covered with a TiCN coating (material), respectively. Example 6 is an example in which quartz powder that is a powder raw material and ion exchanged water that is a liquid raw material were kneaded by using the surface of the rotary kneading discs 10 and 11, the surface of the scrape blade 31, the inner surface of the upper trunk 1, and the inner surface of the lower trunk 2 that were covered with a TiN coating (material), respectively.

Example 7 is an example in which quartz powder that is a powder raw material and ion exchanged water that is a liquid raw material were kneaded by using the surface of the rotary kneading discs 10 and 11 and the surface of the scrape blade 31 that were covered with a DLC coating (material), respectively, and the inner surface of the upper trunk 1 and the inner surface of the lower trunk 2 that were covered with a PEEK coating (material), respectively. Example 8 is an example in which quartz powder that is a powder raw material and ion exchanged water that is a liquid raw material were kneaded by using the surface of the rotary kneading discs 10 and 11 and the surface of the scrape blade 31 that were covered with a TiCN coating (material), respectively, and the inner surface of the upper trunk 1 and the inner surface of the lower trunk 2 that were covered with a PEEK coating (material), respectively. Example 9 is an example in which quartz powder that is a powder raw material and ion exchanged water that is a liquid raw material were kneaded by using the surface of the rotary kneading discs 10 and 11 and the surface of the scrape blade 31 that were covered with a TiN coating (material), respectively, and the inner surface of the upper trunk 1 and the inner surface of the lower trunk 2 that were covered with a PEEK coating (material), respectively.

Example 10 is an example in which mixed powder for food that is a powder raw material and saline water that is a liquid raw material were kneaded by using the rotary kneading discs 10 and 11, the scrape blade 31, the upper trunk 1, and the lower trunk 2 that were made of a PTFE material, respectively. Example 11 is an example in which quartz powder that is a powder raw material and ion exchanged water that is a liquid raw material were kneaded by using the rotary kneading discs 10 and 11 and the scrape blade 31 that were made by a PEEK material, respectively, and the upper trunk 1 and the lower trunk 2 that were made of a PTFE material, respectively. Example 12 is an example in which quartz powder that is a powder raw material and ion exchanged water that is a liquid raw material were kneaded by using the rotary kneading discs 10 and 11, the scrape blade 31, the upper trunk 1, and the lower trunk 2 that were made of a PEEK material, respectively, and the inner surface of the upper trunk 1 and the inner surface of the lower trunk 2 that were covered with a PEEK coating (material), respectively.

Additionally, Comparative Example 1 is an example in which mixed powder for food that is a powder raw material and saline water that is a liquid raw material were kneaded by using the rotary kneading discs 10 and 11, the scrape blade 31, the upper trunk 1, and the lower trunk 2 that were made of stainless steel, respectively. Comparative Example 2 is an example in which quartz powder that is a powder raw material and ion exchanged water that is a liquid raw material were kneaded by using the device having the same configuration as Comparative Example 1. Comparative Example 3 is an example in which quartz powder that is a powder raw material and ion exchanged water that is a liquid raw material were kneaded by using the rotary kneading discs 10 and 11, the scrape blade 31, the upper trunk 1, and the lower trunk 2 that were made of aluminum, respectively.

Additionally, in Examples 1 to 12 and Comparative Example 1, the solid content concentrations of the slurry were commonly 60% in the weight percent of the solid content (powder) to the total weight of the slurry including the liquid. In Comparative Example 2, the solid content concentration of the slurry was 59% in the weight percent of the solid content (powder) to the total weight of the slurry including the liquid, and in Comparative Example 3, the solid content concentration of the slurry was 63% in the weight percent of the solid content (powder) to the total weight of the slurry including the liquid. Additionally, the ambient temperature and the temperature of the powder raw materials and liquid raw materials, during tests, are 20° C. respectively.

In addition, the viscosity was measured by a B-type viscometer BMII model by Toki Sangyo Co. Ltd.

As can be seen from FIG. 7, in Comparative Examples 1 to 3, the inner surfaces of the device constituent members involved in kneading are not covered with coatings, and aluminum or stainless steel metal that is a base metal and has a dynamic friction coefficient of 0.6 or 0.5 is exposed as it is. In this case, it can be seen that the viscosity of the slurry is 420 mPa·S to 640 mPa·S and kneading does not proceed favorably. Under this influence, the temperature of the slurry during kneading is as relatively high as 56° C. to 60° C., and the discharge rate of the slurry did not reach 100%, but stops at 85% or 95%.

In contrast, in many of the cases where the inner surfaces of the device's constituent members involved in kneading are covered with the coating materials with low dynamic friction coefficients or are directly made of the materials with low dynamic friction coefficients as in the invention (Examples 1 to 12), it can be seen that the kneading proceeds favorably such that the viscosity of the slurry is 160 mPa·S to 435 mPa·S. It can be confirmed that, under this influence, the temperature of the slurry during kneading is suppressed to be as relatively low as 50° C., the discharge rate of the slurry also reaches almost 100%, and the discharge performance of the slurry was also excellent.

In addition, in Examples 5 and 6, TiCN and TiN were used as the coating materials. Therefore, it is confirmed that the viscosity of the slurry is high, the discharge rate of the slurry does not reach 100%, but the temperature of the slurry during kneading is kept down to 50° C. or lower, and excellent results are obtained.

INDUSTRIAL APPLICABILITY

The invention relates to a continuous kneading device that continuously kneads powder, such as quartz powder, and liquids.

REFERENCE SIGNS LIST

1: UPPER TRUNK
1DD: INNER FLANGE PORTION
1B: FIRST KNEADING CHAMBER
2: LOWER TRUNK
2B: SECOND KNEADING CHAMBER
3: POWDER SUPPLY CYLINDER
10: FIRST ROTARY KNEADING DISC
11: SECOND ROTARY KNEADING DISC
20: SHEARING KNEADING PORTION
21: FIXED PLATE
21*a*: CUTTING WORK (CONCAVO-CONVEX PORTION)
21*b*: CUTTING WORK (CONCAVO-CONVEX PORTION)
22: ROTARY PLATE
50 (50A, 50B): COATING MATERIAL

The invention claimed is:

1. A continuous kneading device comprising:
a powder supply tube in which a liquid supply pipe is provided in an inside of the powder supply tube;
an upper trunk to which the powder supply tube through which quantified powder is supplied is connected and in which the powder is blended with a liquid; and
a lower trunk concentrically connected to a lower side of the upper trunk,
wherein the powder and the liquid are continuously kneaded by a first rotary kneading disc built in the upper trunk and a second rotary kneading disc built in the lower trunk,
wherein a rotary plate is fixed to an upper surface of the second rotary kneading disc, and a fixed plate is fixed to the upper trunk,
wherein recessed grooves are formed on an upper surface of the rotary plate at regular intervals in a radial direction so as to extend along a circumferential direction that is a rotational direction of the rotary plate,
wherein recessed grooves are formed on a lower surface of the fixed plate at regular intervals in a radial direction so as to extend along a circumferential direction that is a rotational direction of the rotary plate,
wherein the upper surface of the rotary plate faces to the lower surface of the fixed plate, wherein at least the upper surface of the rotary plate and the lower surface of the fixed plate are covered with one compound selected from the group consisting of DLC, PEEK, PTFE, TiN, and TiCN, and
wherein an internal diameter of a second kneading chamber provided on the lower trunk is formed so as to be larger than an internal diameter of a first kneading chamber provided on the upper trunk.

2. The continuous kneading device according to claim 1, wherein inner surfaces of the upper trunk and the lower trunk are covered with a coating material having a lower dynamic friction coefficient than that of metal.

3. The continuous kneading device according to claim 2, wherein the coating material covered on the inner surfaces of the upper trunk and the lower trunk is PEEK.

4. The continuous kneading devices according to claim 1, wherein the first and second rotary kneading discs are constituted of a resin material having a lower dynamic friction coefficient than that of metal.

5. The continuous kneading device according to claim 1, wherein the rotary plate rotates in a state where the rotary plate faces an upper surface of the fixed plate, and thereby a shearing force is given to the kneaded matter of the powder and the liquid between the fixed plates and the rotary plate.

6. The continuous kneading device according to claim 4, wherein the resin material having a lower dynamic friction coefficient than that of metal is PEEK or PTFE.

7. The continuous kneading device according to claim 2, wherein the rotary plate rotates in a state where the rotary plate faces an upper surface of the fixed plate, and thereby a shearing force is given to the kneaded matter of the powder and the liquid between the fixed plates and the rotary plate.

8. The continuous kneading device according to claim 3, wherein the rotary plate rotates in a state where the rotary plate faces an upper surface of the fixed plate, and thereby a shearing force is given to the kneaded matter of the powder and the liquid between the fixed plates and the rotary plate.

9. The continuous kneading device according to claim 4, wherein the rotary plate rotates in a state where the rotary plate faces an upper surface of the fixed plate, and thereby a shearing force is given to the kneaded matter of the powder and the liquid between the fixed plates and the rotary plate.

10. The continuous kneading device according to claim 7, wherein concavo-convex portions are formed in the surfaces of the fixed plate and the rotary plate that face each other.

11. The continuous kneading device according to claim 8, wherein concavo-convex portions are formed in the surfaces of the fixed plate and the rotary plate that face each other.

12. The continuous kneading device according to claim 9, wherein concavo-convex portions are formed in the surfaces of the fixed plate and the rotary plate that face each other.

13. A continuous kneading devices comprising:

a powder supply tube;

an upper trunk to which the powder supply tube through which quantified powder is supplied is connected; and a lower trunk concentrically connected to a lower side of the upper trunk, wherein the powder is continuously kneaded by a first rotary kneading disc built in the upper trunk and a second rotary kneading disc built in the lower trunk, wherein a rotary plate is fixed to an upper surface of the second rotary kneading disc, and a fixed plate is fixed to the upper trunk, wherein recessed grooves are formed on an upper surface of the rotary plate at regular intervals in a radial direction so as to extend along a circumferential direction that is a rotational direction of the rotary plate, wherein recessed grooves are formed on a lower surface of the fixed plate at regular intervals in a radial direction so as to extend along a circumferential direction that is a rotational direction of the rotary plate, wherein the upper surface of the rotary plate faces to the lower surface of the fixed plate, wherein at least the upper surface of the rotary plate and the lower surface of the fixed plate are covered with one compound selected from the group consisting of DLC, PEEK, PTFE, TiN, and TiCN, wherein a flange portion protruding radially outward are integrally formed at a lower edge portion of the upper trunk, wherein a fluid injection nozzle is provided in the lower flange portion, wherein the fluid injection nozzle has a configuration that a liquid is directly supplied to a place in which the fixed plate and the rotary plate face each other, and wherein an internal diameter of a second kneading chamber provided on the lower trunk is formed so as to be larger than an internal diameter of a first kneading chamber provided on the upper trunk.

* * * * *